US005636463A

United States Patent [19]

Sharon et al.

[11] Patent Number: 5,636,463

[45] Date of Patent: Jun. 10, 1997

[54] ADJUSTABLE MENU BOARD

[75] Inventors: Scott W. Sharon, Covington; James E. Bradley, Independence, both of Ky.

[73] Assignee: LSI Industries, Inc., Cincinnati, Ohio

[21] Appl. No.: 499,833

[22] Filed: Jul. 10, 1995

[51] Int. Cl.[6] ..... G09F 13/04

[52] U.S. Cl. ..... 40/618; 40/568

[58] Field of Search ..... 40/618, 568, 576, 40/585

[56] References Cited

U.S. PATENT DOCUMENTS

| | | | |
|---|---|---|---|
| 1,120,876 | 12/1914 | Witz | 40/618 X |
| 1,887,591 | 11/1932 | Fugita | 40/618 |
| 2,561,813 | 7/1951 | Murphy . | |
| 2,615,380 | 10/1952 | Murphy . | |
| 3,419,979 | 1/1969 | McVicker et al. | 40/618 |
| 3,680,525 | 8/1972 | Berge . | |
| 4,345,396 | 8/1982 | Janssen | 40/490 |
| 4,367,604 | 1/1983 | Porter, II et al. | 40/564 |
| 4,461,107 | 7/1984 | Grate | 40/576 |
| 4,521,984 | 6/1985 | Murray | 40/611 X |
| 4,682,430 | 7/1987 | Ramsay | 40/618 |
| 5,088,221 | 2/1992 | Bussiere et al. | 40/618 |
| 5,347,736 | 9/1994 | Kanigan | 40/618 X |

FOREIGN PATENT DOCUMENTS

| | | | |
|---|---|---|---|
| 2404882 | 6/1979 | France | 40/618 |

*Primary Examiner*—Joanne Silbermann
*Attorney, Agent, or Firm*—Wood, Herron & Evans

[57] ABSTRACT

A menu board for supporting elongated menu strips of varying heights is disclosed having adjustable guide rails supported in a frame. The frame includes side members incorporating guide rail support elements disposed along the length of the side members to releasably engage the guide rails. The guide rails are selectively positionable along the length of the side members to provide adjustable spacing between adjacent pairs of guide rails. The menu strips include descriptive indicia such as product names and pricing information and are disposed between and supported by adjacent pairs of the guide rails.

34 Claims, 3 Drawing Sheets

ADJUSTABLE MENU BOARD

FIELD OF THE INVENTION

The present invention relates generally to menu boards and, more particularly, to such menu boards utilizing elongated menu strips having descriptive indicia to display menu item names and pricing information.

BACKGROUND OF THE INVENTION

Menu boards are widely used at fast food restaurants, for example, to display menu item descriptions and pricing information to a customer. Such menu boards are generally used at drive-thru services and within the interior of the restaurants to inform the customer of the available products, their prices, and may also include photographs of special menu items. Typically, the menu board is mounted as a front panel to an illuminating box containing a light source for back-lighting the menu board from the interior of the box.

In menu boards of the type described above, it is well known in the art to provide menu item descriptions and pricing information on elongated menu strips which are then positioned forwardly of the light source. The menu strips may include transparent characters or numerals which are thus illuminated by the light source while an opaque surface on the menu strip prevents light from being transmitted through other areas of the menu strip. Examples of such menu strip designs may be found in Porter, II et al., U.S. Pat. No. 4,367,604 and Grate, U.S. Pat. No. 4,461,107 wherein the menu strips are positioned on the menu board between adjacent pairs of guide rails fixed to a front or rear surface of the menu board.

It is generally common in the fast food industry to have menu strips with varying heights as different menu items require more or less description of the product. For example, one menu strip may contain the description "Hamburger" while another menu strip may describe a special combination of "Hamburger", "French Fries" and "Drink", with these descriptions being presented in three separate lines on the menu strip to reduce customer confusion in selecting from available products. In the latter example, it will be recognized that the menu strip will have a greater height than in the former example. Moreover, the restaurant may include photographs of special menu items presented on flexible strips of varying heights which are also positioned forwardly of the light source between adjacent pairs of guide rails.

In the past, menu boards were typically customized for a particular application with the spacing between adjacent pairs of guide rails being fixed at the time of installation. Thus, a fast food restaurant could not change the spacing of the guide rails to accommodate menu strips of varying heights without having to purchase a completely new menu board with different guide rail spacing.

One known attempt has been made in Murray, U.S. Pat. No. 4,521,984 to provide a menu board with limited flexibility to accommodate menu strips of varying heights. In this disclosure, a rigid frame is provided with a series of slots along a pair of side members to capture the guide rails in the slots before final assembly of the frame. In this way, variable spacing between adjacent guide rails is provided by varying the spacing between adjacent slots in the frame. Notwithstanding this effort, however, the menu board frame has fixed spacing between adjacent pairs of guide rails after the menu board has been assembled. Thus, once the frame has been assembled, the spacing between adjacent pairs of guide rails cannot be changed to accommodate menu strips or photographs of varying heights.

Accordingly, a primary object of the present invention is to provide an improved menu board which has flexibility to accommodate menu strips or photographs of varying heights.

Another object of the present invention is to provide such a menu board which is easy to manufacture and economical to use.

Yet another object of the present invention is to provide such a menu board which is readily adaptable to changes in menu item descriptions or in product pricing.

SUMMARY OF THE INVENTION

To these ends, an adjustable menu board is provided having a top, a bottom and a pair of side members joined as a rigid frame. The side members of the frame incorporate a series of guide rail support elements disposed along the length of the side members to engage with a series of generally parallel guide rails inserted into the frame. The guide rails are selectively engageable at their opposite ends with the guide rail support elements to provide adjustable spacing between adjacent pairs of the guide rails. A series of elongated menu strips having descriptive indicia, including menu item names and pricing information, are disposed between and supported by different adjacent pairs of the guide rails.

The menu strips include a substantially transparent rear strip joined to an overlying front strip having descriptive indicia thereon to display menu item names. The descriptive indicia is outlined and thereby defined by a surrounding opaque surface of the front member. The front strip further includes a series of windows which are coextensive with a series of pockets formed between the front and rear strips to receive character strips for displaying interchangeable pricing information.

In one embodiment, the guide rails are slotted longitudinally to slidably receive the menu strips between adjacent pairs of the guide rails. The guide rails include an "H-shaped" cross-section front member and a rearwardly extending clip member which is adapted to be releasably engageable with the guide rail support elements. The front members thereby define a series of sleeves between adjacent pairs of the guide rails to slidably receive the menu strips within the sleeves. To accommodate for changes in menu strip height, the guide rails are selectively positionable at varying locations along the length of the side members to provide adjustable spacing between adjacent pairs of the guide rails.

BRIEF DESCRIPTION OF THE DRAWINGS

The accompanying drawings, which are incorporated in and constitute a part of this specification, illustrate an embodiment of the invention and, together with the general description of the invention given above and the detailed description of an embodiment given below, serve to explain the principles of the present invention.

DETAILED DESCRIPTION OF THE INVENTION

Figure 1:
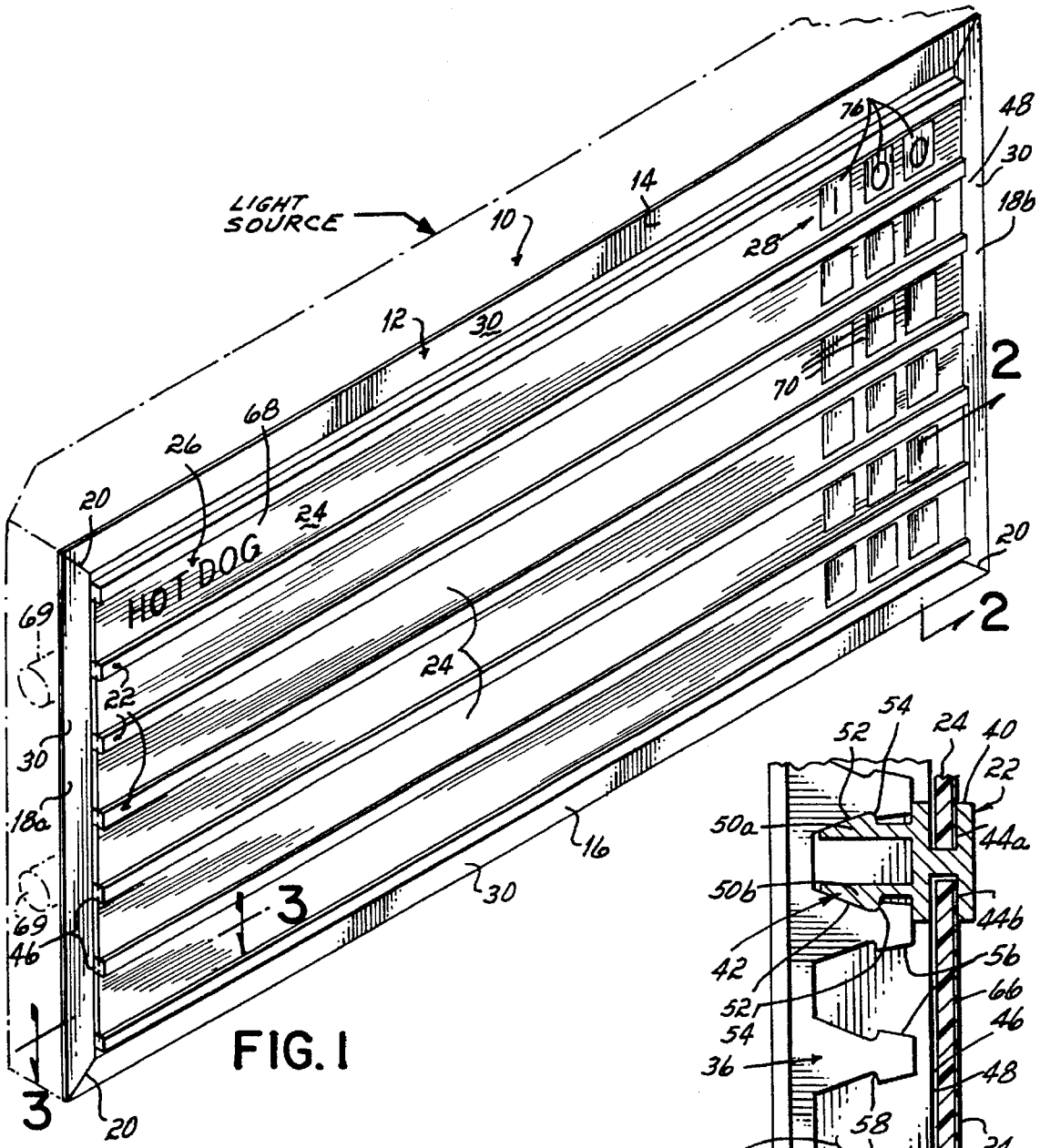
FIG. 1 is a perspective view of an adjustable menu board in accordance with the general principles of the present invention.

Referring now in detail to the drawings, an adjustable menu board 10 in accordance with the principles of the present invention is shown in FIG. 1. Menu board 10 includes a frame 12, having a generally rectangular shape, including a top member 14, a bottom member 16 and a pair of side members 18*a* and 18*b*. Preferably, members 14, 16, 18*a* and 18*b* are stamped metal parts which are then joined at mitered corners 20 by brackets (not shown) welded to a rearward surface of the frame 12. In this way, the members 14, 16, 18*a* and 18*b* may be readily manufactured with varying horizontal and vertical dimensions for customizing frames 12 to a particular menu board application.

With further reference to FIG. 1, menu board 10 includes a series of parallel guide rails 22 disposed in the frame 12 for supporting elongated menu strips 24 between adjacent pairs of guide rails 22 as will be described in more detail below. Guide rails 22 are extruded and cut to a desired horizontal length for a particular dimension of frame 12. As shown in FIG. 1, the menu strips 24 include customized product description indicia 26 and interchangeable pricing information indicia 28, such as "HOT DOG" and 1.00 dollar, respectively, for displaying available menu items and pricing to a customer.

Figure 2:
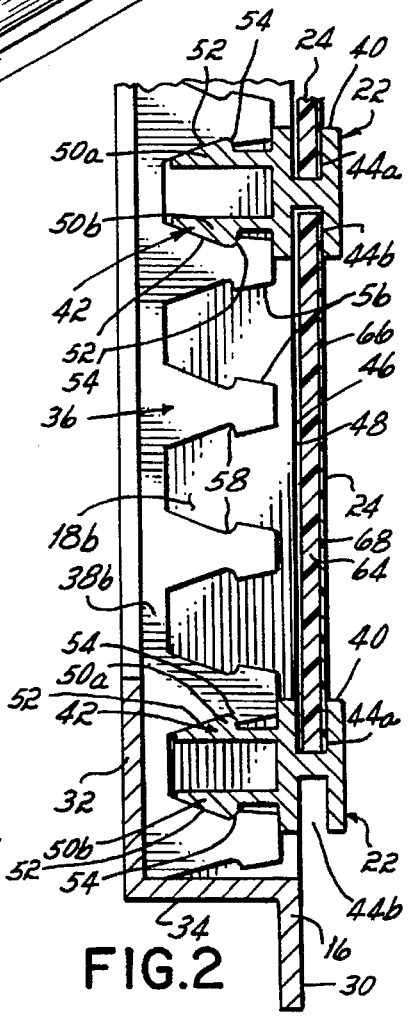
FIG. 2 is a cross-sectional view of the adjustable menu board of FIG. 1 taken along lines 2—2.
Figure 3:
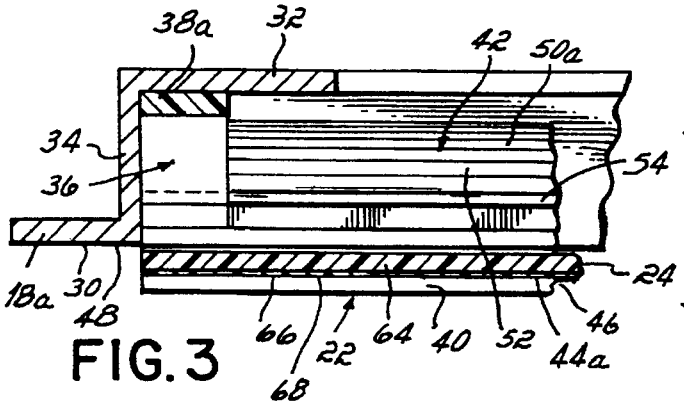
FIG. 3 is a cross-sectional view of the adjustable menu board of FIG. 1 taken along lines 3—3.

As shown in FIGS. 2 and 3, the top, bottom and side members 14, 16, 18*a* and 18*b*, respectively, have a preferred "Z-shaped" cross-section to add strength and rigidity to the frame 12. Each member 14, 16, 18*a* and 18*b* includes a front portion 30, a rear portion 32 which is parallel to the front portion 30, and a leg 34 normal to front and rear portions 30 and 32, respectively. In one embodiment, the front portion 30 extends from the leg 34 toward the outside of the frame 12 and the rear portion 32 extends from the leg 34 toward the inside of the frame 12.

Figure 4:
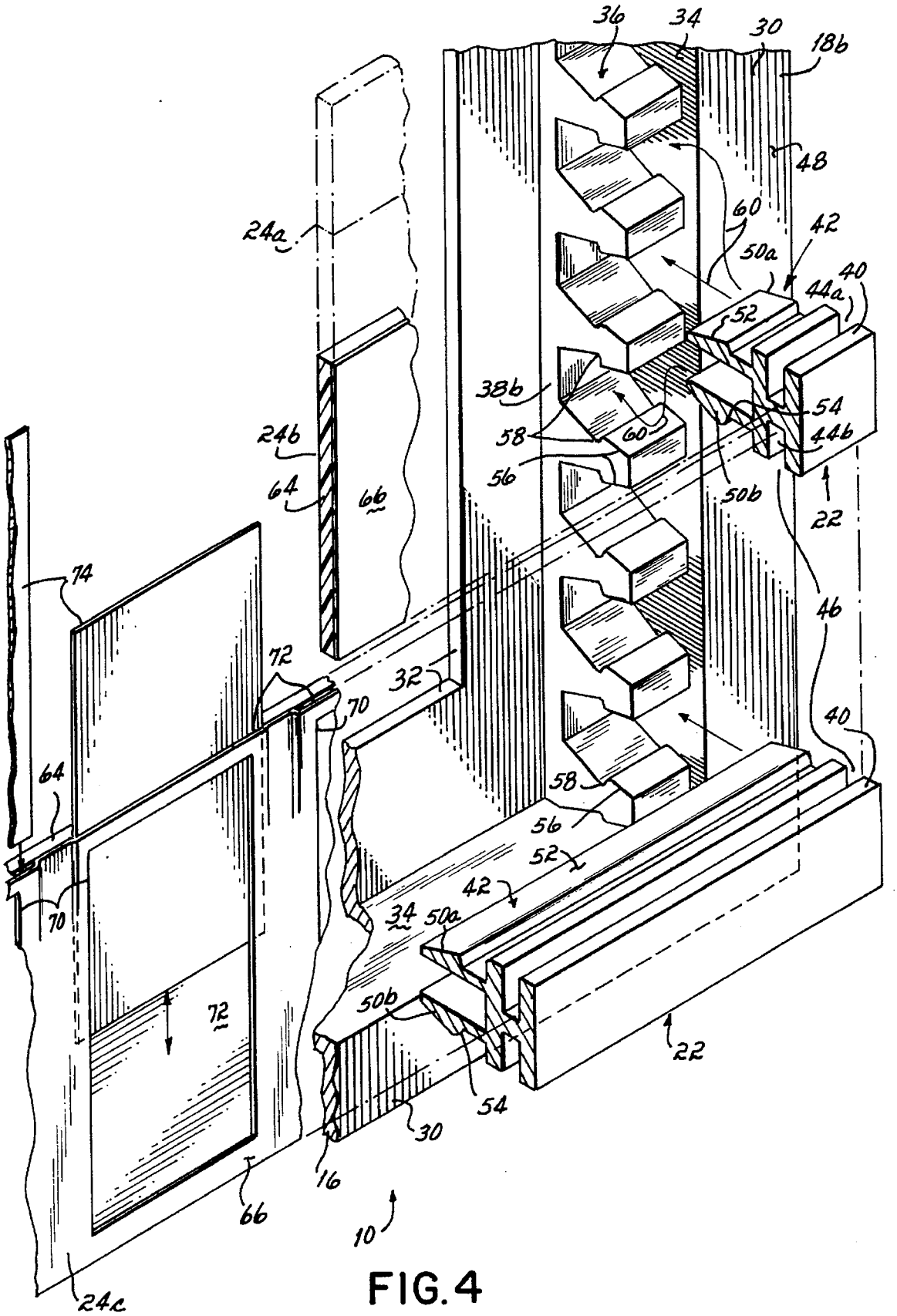
FIG. 4 is an enlarged disassembled perspective view, partially broken away, of the adjustable menu board of FIG. 1.

In accordance with the invention, the menu board 10 includes a series of incrementally spaced guide rail support elements 36 disposed along the length of side members 18*a* and 18*b* (one shown) for releasably engaging the guide rails 22. In one embodiment as shown in FIGS. 2–4, the guide rail support elements 36 are preferably disposed along a pair of tracks 38*a* and 38*b* mounted to the side members 18*a* and 18*b*, respectively. An adhesive layer is disposed intermediate each track 38*a* and 38*b* and each rear portion 32 of the side members 18*a* and 18*b* to join the tracks to the side members. In this way, tracks 38*a* and 38*b* are horizontally spaced in accordance with the spacing between respective side members 18*a* and 18*b*, with track 38*a* mounted to side member 18*a* and track 38*b* mounted to side member 18*b*. The guide rail support elements 36 are disposed vertically along each of the horizontally spaced tracks 38*a* and 38*b*. The tracks 38*a* and 38*b* are preferably manufactured of moldable material, such as plastic or the like, to provide the desired configuration and spacing of guide rail support elements 36. In this way, the tracks 38*a* and 38*b* can be efficiently manufactured and customized for a particular menu board application, e.g., with greater or lesser spacing between adjacent guide rails 22, without having to make any changes to the frame 12, and side members 18*a* and 18*b* in particular.

It is equally contemplated that the tracks 38*a* and 38*b* could be milled from a material such as metal, wood or the like, for example, to provide the desired spacing and configuration of guide rail support elements 36. It will also be appreciated by those skilled in the art that the tracks 38*a* and 38*b* could be dispensed with, and the guide rail support elements 36 could be welded or otherwise joined directly to the side members 18*a* and 18*b* (not shown). It will further be appreciated that, in another embodiment, the guide rail support elements 36 could be milled directly from the side members 18*a* and 18*b* (not shown).

As shown most clearly in FIGS. 2 and 4, the guide rail support elements 36 are disposed at predetermined equally spaced intervals along the length of the side members 18*a* and 18*b* to provide adjustable spacing between adjacent pairs of guide rails, such as between guide rails 22 in FIG. 2. In one embodiment, the guide rail support elements 36 are uniformly disposed at about ⅜" intervals. It will be appreciated by those skilled in the art, however, that greater or lesser spacing between adjacent guide rail support elements 36 is possible without departing from the spirit of the present invention.

With further reference to FIGS. 2 and 4, guide rails 22 preferably include a front member 40 having an "H-shaped" cross-section and an integral rearwardly extending clip member 42 which is adapted to be releasably engageable intermediate adjacent pairs of guide rail support elements 36. The front members 40 have upper and lower longitudinal slots 44*a* and 44*b*, respectively, for defining sleeves 46 between adjacent pairs of guide rails, such as between guide rails 22 in FIG. 2. Preferably, the sleeves 46 are disposed forwardly of a front face 48 of the side members 18*a* and 18*b* such that the menu strips 24 are slidably received within the sleeves 46 from either side of the guide rails 22. It will be appreciated by those skilled in the art that the front members 40 could be modified to a "T", "double-T", or "double-H" cross-section, for example, without departing from the spirit of the present invention.

As shown most clearly in FIGS. 2 and 4, each of the clip members 42 preferably includes a pair of rearwardly extending legs 50*a* and 50*b*. The legs 50*a* and 50*b* include a camming surface 52 and a shoulder 54 which cooperate with a camming surface 56 and a shoulder 58 of the guide rail support elements 36 for releasably engaging the guide rails 22 along the length of the pair of tracks 38*a* and 38*b*. As the guide rails 22 are inserted into the tracks 38*a* and 38*b*, the camming surfaces 52 of the legs 50*a* and 50*b* cooperate with the camming surfaces 56 of the guide rail support elements 36 to cause the legs to resiliently compress toward each other until the shoulders 54 of the legs ride over and clear the shoulders 58 of the guide rail support elements. Likewise, as the guide rails 22 are removed from the pair of tracks 38*a* and 38*b*, the legs 50*a* and 50*b* resiliently compress toward each other as the shoulders 54 of the legs ride over and clear the shoulders 58 of the guide rail support elements 36. In this way, the guide rails 22 are selectively engageable with the guide rail support elements 36 along the length of the pair of tracks 38*a* and 38*b*.

As shown most clearly in FIG. 4, the guide rails 22 are selectively engageable intermediate adjacent pairs of guide rail support elements 36, as shown by arrows 60 in the figure, to provide adjustable spacing between adjacent pairs of the guide rails, such as between the guide rails 22 in FIG. 4. In this way, menu strips 24*a*, 24*b* and 24*c*, or photographs (not shown), of varying heights can be accommodated in the sleeves 46 formed between adjacent pairs of guide rails 22 without having to structurally modify, or replace all together, the menu board 10 of the present invention. It will be appreciated that in the embodiments shown in the figures, the menu strips 24 will have a height that is substantially a multiple of the predetermined equally spaced intervals of guide rail support elements 36. Thus, with reference to FIG. 2, for example, if the guide rail support elements 36 are disposed at ½ inch intervals, the menu strip 24 shown in FIG. 2 will have an approximate height of 2.0 inches.

With further reference to FIG. 4, the elongated menu strips, such as menu strip 24*c*, include a substantially transparent rear strip 64 adhesively or otherwise joined to an overlying front strip 66. The product description indicia 26 (see FIG. 1) is outlined and thereby defined by a surrounding opaque surface 68 of the front strip 66. In this way, the product description indicia 26 is back-lit from a light source including light bulbs 69 positioned behind the menu board 10. The front strip 66 further includes a series of windows 70 through which interchangeable pricing information indicia 28 is shown (see FIGS. 1 and 4). Pockets 72 are formed intermediate the front and rear strips 64 and 66, respectively, and coextensive with the windows 70, for receiving interchangeable character strips 74 (see FIG. 4). The pricing information indicia 28 is outlined and thereby defined by a surrounding opaque surface 76 of the character strips 74. In this way, the pricing information indicia 28 is readily changed by interchanging the character strips 74 in the pockets 72 of the menu strips 24.

In manufacturing the menu board 10 of the present invention, the top, bottom and side members 14, 16, 18*a* and 18*b* are stamped and cut to a desired horizontal and vertical length for a specific menu board application and then joined at the mitered corners 20 to form a rigid frame 12. Next, guide rails 22 are extruded and cut to a desired horizontal length for the particular dimension of the frame 12. A pair of tracks 38*a* and 38*b* are manufactured having the desired configuration and spacing of guide rail support elements 36 and then the tracks are adhesively or otherwise joined to the side members 18*a* and 18*b*, respectively. The guide rails 22 are then selectively engaged with the guide rail support elements 36 along the length of the side members 18*a* and 18*b* to provide a desired spacing between adjacent pairs of guide rails 22. The desired spacing of the guide rails 22 is determined by the height of the menu strips 24 or photographs (not shown) to be used in the menu board 10. Lastly, the menu strips 24 having the desired product description indicia 26 and pricing information indicia 28, and photographs, are slidably received in sleeves 46 formed between adjacent pairs of guide rails 22. When the product description indicia 26 and photographs become obsolete as menu items change, for example, the menu strips 24 and photographs are readily replaced in the sleeves 46. When the pricing information indicia 28 needs to be changed, the character strips 74 in the pockets 72 are interchanged to display the correct price of the menu item through the windows 70.

In accordance with the present invention, when the height of one or more menu strips 24 must be changed, the guide rails 22 are first disengaged from the guide rail support elements 36. The guide rails 22 are then selectively repositioned along the side members 18*a* and 18*b* to provide new sleeves 46 having the proper height to accommodate the height variance in the menu strips 24. In this way, the present invention provides a flexibility in menu board design heretofore unknown in the prior an for accommodating changes in menu strip height after installation of the menu board.

While a preferred embodiment has been shown and described with reference to FIGS. 2–4, those skilled in the an will appreciate that modifications may be made to the preferred embodiment without departing from the spirit of the present invention. For example, those skilled in the art will recognize that mechanical pans could easily be reversed, e.g., the guide rail support elements 36 could be reversed with the clip members 42 of the guide rails 22 while still providing adjustable spacing between adjacent pairs of guide rails as contemplated by the present invention.

Figure 5:
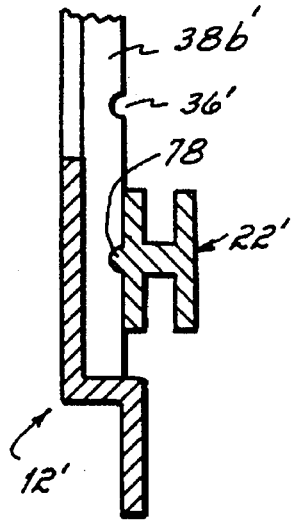
FIG. 5 is a view similar to FIG. 2 showing an alternative embodiment of the present invention.

In an alternative embodiment of the present invention as shown in FIG. 5, the tracks 38*a* and 38*b* of FIGS. 2–4 are replaced with a pair of magnetic tracks 38*a*' and 38*b*' (one shown) having guide rail support elements 36' disposed at predetermined equally spaced intervals along the length of the tracks. The tracks 38*a*' and 38*b*' are magnetically attached to side members (not shown) of a frame 12', and the guide rails 22' are magnetically attached to the pair of magnetic tracks 38*a*' and 38*b*'. In this embodiment, the guide rails 22' include detents 78 at their opposite ends which are received within the guide rail support elements 36', shown as dimples, to provide adjustable spacing between adjacent pairs of the guide rails 22'.

Figure 6:
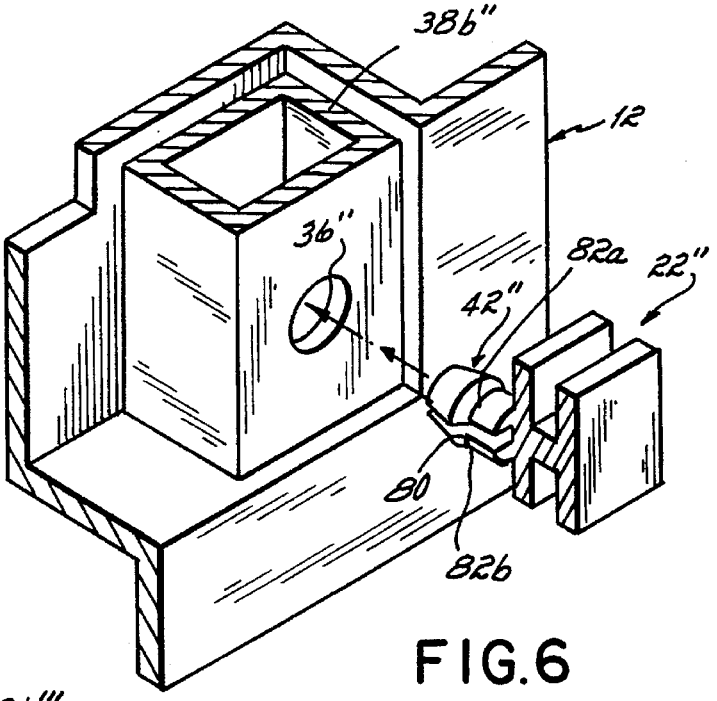
FIG. 6 is a view similar to FIG. 4 showing another alternative embodiment of the present invention.

In another embodiment as shown in FIG. 6, the tracks 38*a* and 38*b* are replaced with tubular tracks 38*a*" and 38*b*" (one shown) attached to the frame 12 and having guide rail support elements 36", shown as apertures, uniformly spaced along the length of the tracks. Guide rails 22" are provided at their opposite ends with a rearwardly extending clip member 42" having a button 80 which is releasably engageable with the guide rail support elements 36". The clip member 42" includes a pair of legs 82*a* and 82*b* which are resiliently compressible toward each other in the same manner as legs 50*a* and 50*b* of the clip member 42 shown in FIGS. 2–4.

Figure 7:
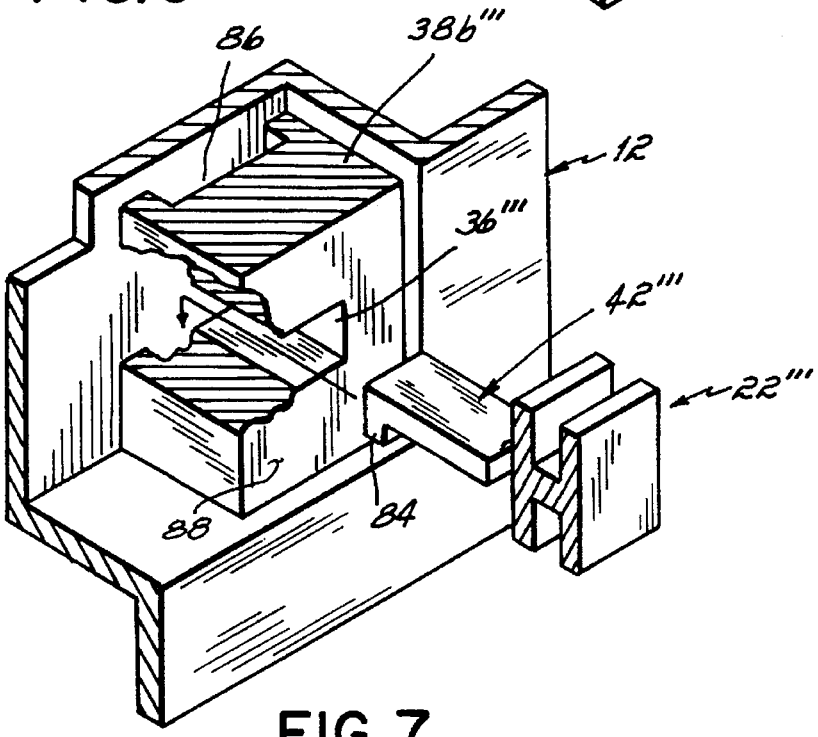
FIG. 7 is a view similar to FIG. 4 showing yet another alternative embodiment of the present invention.

In yet another embodiment of the present invention as shown in FIG. 7, the tracks 38*a* and 38*b* are replaced with tracks 38*a*'" and 38*b*'" (one shown) attached to the frame 12. The tracks 38*a*'" and 38*b*'" include guide rail support elements 36'", shown as slots, uniformly disposed along the length of the tracks for supporting guide rails 22'". In this embodiment, the guide rails 22'" include a rearwardly extending clip member 42'" having a downwardly turned flange 84 which is selectively engageable with a recessed channel 86 in the tracks 38*a*'" and 38*b*'". As the clip members 42'" are inserted into the guide rail support elements 36'", the flange 84 is received within the channel 86 to support the guide rails 22'" against a front face 88 of the tracks 38*a*'" and 38*b*'".

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicant's invention.

Having described the invention, what is claimed is:

1. An adjustable menu board, comprising:

an assembled frame having a top, a bottom and a pair of side members defining a plane, and a space defined between said top, bottom, and side members, said side members including a plurality of horizontally spaced guide rail support elements disposed vertically along said side members;

a plurality of generally parallel guide rails selectively engageable and disengageable at their opposite ends with different ones of said guide rail support elements, said guide rails thereby being selectively positionable at regularly and variably spaced locations vertically along said side members in a direction intersecting the plane defined by said frame to provide the same and different spacing between adjacent pairs of said guide rails; and a plurality of elongated menu strips having descriptive indicia thereon, each of said menu strips being disposed between and supported by a different one of said adjacent pairs of guide rails.

2. The adjustable menu board of claim 1 wherein said ends of said guide rails are releasably engageable with said guide rail support elements.

3. The adjustable menu board of claim 2 wherein each of said guide rails has a front member having an "H-shaped" cross-section and an integral rearwardly extending clip member, said clip member being adapted to be releasably engageable with said guide rail support elements.

4. The adjustable menu board of claim 3 wherein said clip member comprises a pair of rearwardly extending legs, said pair of legs being resiliently compressible toward each other when said guide rails are inserted in and removed from said guide rail support elements.

5. The adjustable menu board of claim 3 wherein said front members define a plurality of sleeves between adjacent pairs of said guide rails, each of said menu strips being slidably received in one of said sleeves.

6. The adjustable menu board of claim 5 wherein said plurality of sleeves is disposed forwardly of a front face of said side members.

7. The adjustable menu board of claim 1 wherein said menu strips are slidably engaged by said guide rails.

8. The adjustable menu board of claim 1 wherein said guide rails are slotted longitudinally to slidably receive opposite longitudinal edges of one of said menu strips between an adjacent pair of said guide rails.

9. The adjustable menu board of claim 1 wherein at least one of said menu strips has a height measured in a direction parallel to the length of said side members that is different than the height of said at least one other menu strip.

10. The adjustable menu board of claim 1 wherein said guide rail support elements are disposed at predetermined equally spaced intervals along the length of said side members.

11. The adjustable menu board of claim 10 wherein each of said menu strips has a height measured in a direction parallel to the length of said side members that is substantially a multiple of said predetermined intervals.

12. The adjustable menu board of claim 1 wherein said top, bottom and side members have a "Z-shaped" cross-section, each of said members having a front portion parallel to a rear portion thereof, said front and rear portions being interconnected by a leg normal to each portion.

13. The adjustable menu board of claim 12 wherein said front portion extends from said leg toward the outside of said frame and said rear portion extends from said leg toward the inside of said frame.

14. The adjustable menu board of claim 1 wherein each of said elongated menu strips comprises a substantially transparent rear strip joined to an overlying front strip, said descriptive indicia being outlined and thereby defined by a surrounding opaque surface of said front strip.

15. The adjustable menu board of claim 14 wherein said front strip includes a plurality of windows, each of said menu strips having a pocket intermediate said front and rear strips and coextensive with each of said windows.

16. The adjustable menu board of claim 15 wherein said menu strips further include a plurality of character strips having descriptive indicia, each of said character strips being received in one of said pockets.

17. The adjustable menu board of claim 16 wherein said descriptive indicia is outlined and thereby defined by a surrounding opaque surface of said character strip.

18. The adjustable menu board of claim 1 further comprising a light transmitting source positioned rearwardly of said menu board and operable to back light said plurality of elongated menu strips.

19. The adjustable menu board of claim 1 wherein each of said guide rails includes a rearwardly facing element which is compressible in a direction parallel to the longitudinal axis of said side members.

20. The adjustable menu board of claim 19 wherein said guide rail support elements are non-compressible in a direction parallel to the longitudinal axis of said side members.

21. An adjustable menu board for use with a plurality of elongated menu strips having descriptive indicia thereon and collectively having at least two different heights, comprising:

an assembled frame having a top, a bottom and a pair of side members defining a plane, and a space defined between said top, bottom and side members, said side members including a plurality of horizontally spaced guide rail support elements disposed vertically along said side members; and a plurality of generally parallel guide rails selectively engageable and disengageable at their opposite ends with different ones of said guide rail support elements, said guide rails thereby being selectively positionable at regularly and variably spaced locations vertically along said side members in a direction intersecting the plane defined by said frame to provide the same and different spacing between adjacent pairs of said guide rails for supportingly receiving said menu strips of different heights.

22. The menu board of claim 21 wherein said menu strips are slidably engaged by said guide rails.

23. The adjustable menu board of claim 22 wherein said top, bottom and side members have a "Z-shaped" cross-section, each of said members having a front portion parallel to a rear portion thereof, said front and rear portions being interconnected by a leg normal to each portion.

24. The adjustable menu board of claim 23 wherein said front portion extends from said leg toward the outside of said frame and said rear portion extends from said leg toward the inside of said frame.

25. The adjustable menu board of claim 21 wherein said guide rails are slotted longitudinally to slidably receive opposite longitudinal edges of one of said menu strips between an adjacent pair of said guide rails.

26. The adjustable menu board of claim 21 wherein said guide rail support elements are disposed at predetermined equally spaced intervals along the length of said side members.

27. The adjustable menu board of claim 21 wherein each of said guide rails has a front member having an "H-shaped" cross-section and an integral rearwardly extending clip member, said clip member being adapted to be releasably engageable with said guide rail support elements.

28. The adjustable menu board of claim 27 wherein said clip member comprises a pair of rearwardly extending legs, said pair of legs being resiliently compressible toward each other when said guide rails are inserted in and removed from said guide rail support elements.

29. The adjustable menu board of claim 27 wherein said front members define a plurality of sleeves between adjacent pairs of said guide rails, each of said menu strips being slidably received in one of said sleeves.

30. The adjustable menu board of claim 29 wherein said plurality of sleeves is disposed forwardly of a front face of said side members.

31. The adjustable menu board of claim 21 further comprising a light transmitting source positioned rearwardly of said menu board and operable to back light said menu strips of different heights.

32. The adjustable menu board of claim 21 wherein each of said guide rails includes a rearwardly facing element which is compressible in a direction parallel to the longitudinal axis of said side members.

33. The adjustable menu board of claim 32 wherein said guide rail support elements are non-compressible in a direction parallel to the longitudinal axis of said side members.

34. An adjustable menu board, comprising:

an assembled frame having a top, a bottom and a pair of side members defining a plane, and a space defined between said top, bottom and side members;

a pair of elongated track members, each of said track members being mounted on a respective one of said side members and together having a plurality of horizontally spaced guide rail support elements disposed vertically along their respective lengths;

a plurality of generally parallel guide rails selectively engageable and disengageable at their opposite ends with different ones of said guide rail support elements, said guide rails thereby being selectively positionable at regularly and variably spaced locations vertically along said track members in a direction intersecting the plane defined by said frame to provide the same and different spacing between adjacent pairs of said guide rails; and a plurality of elongated menu strips having descriptive indicia thereon, each of said menu strips being disposed between and supported by a different one of said adjacent pairs of guide rails.

* * * * *